United States Patent [19]

Ratchford et al.

[11] 4,433,889

[45] Feb. 28, 1984

[54] ELECTRICAL CONNECTOR HAVING A MOISTURE SEAL

[75] Inventors: Lloyd G. Ratchford, Oneonta; Dee A. Werth, Afton; Vincent A. Luca, Jr.; Alan L. Schildkraut, both of Sidney, all of N.Y.

[73] Assignee: The Bendix Corporation, Southfield, Mich.

[21] Appl. No.: 334,866

[22] Filed: Dec. 28, 1981

[51] Int. Cl.[3] ..... H01R 13/52

[52] U.S. Cl. ..... 339/94 M; 339/45 M

[58] Field of Search ..... 339/94 R, 94 A, 94 C, 339/94 L, 94 M, 126 R, 126 RS, 60 R, 60 M, 59 R, 59 M, 61 R, 61 M, 61 C, 61 L, 59 L, 60 C

[56] References Cited

U.S. PATENT DOCUMENTS

| | | | |
|---|---|---|---|
| 3,359,526 | 12/1967 | Bakker | 339/60 R |
| 3,486,162 | 12/1969 | Leitmann | 339/61 R |
| 3,644,938 | 2/1972 | Slate | 339/94 R |
| 3,649,955 | 3/1972 | Schmidt et al. | 339/94 A |
| 4,312,553 | 1/1982 | Lyckesjo | 339/94 M |

*Primary Examiner*—Joseph H. McGlynn
*Assistant Examiner*—David L. Pirlot
*Attorney, Agent, or Firm*—C. D. Lacina

[57] ABSTRACT

Mating forward ends (14, 24) of a receptacle connector (10) mounted in a panel (18) and plug connector (20) carrying a coupling member (30, 34, 40) are protected by a moisture seal (60) when interconnected. The moisture seal comprises a tubular body portion (64) which squeezes about the coupling member and a cup portion (66) which collapsibly compresses about the panel mounted connector, tubular body (64) including an annular shoulder (62) sized to be received in an annular cavity (50) around a sleeve (40) of the coupling member. The cup (64) comprises a frust-conical skirt (68), an annular collar (67) connecting the skirt to the body (64) and an annular foot (69) for sealing about the panel (18), reduced thicknesses (71, 73, 74) of tubular body portion (64) and annular collar (67) allowing cup portion (64) to collapse rearwardly relative to the coupling member when the annular foot (69) is forced against the panel (18).

6 Claims, 9 Drawing Figures

FIG. 1
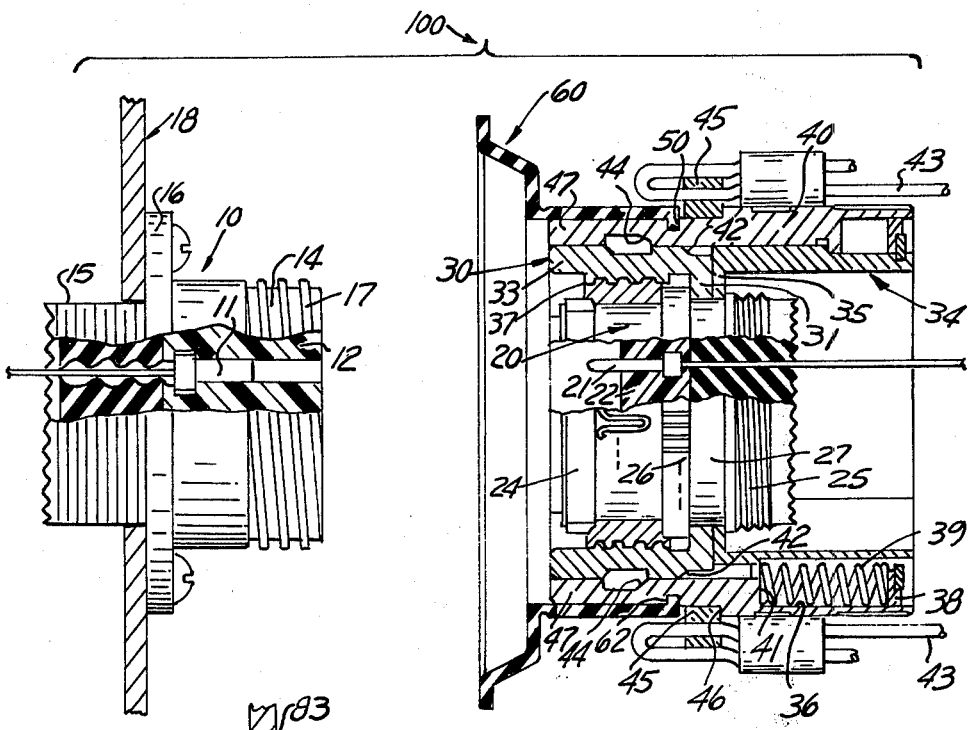
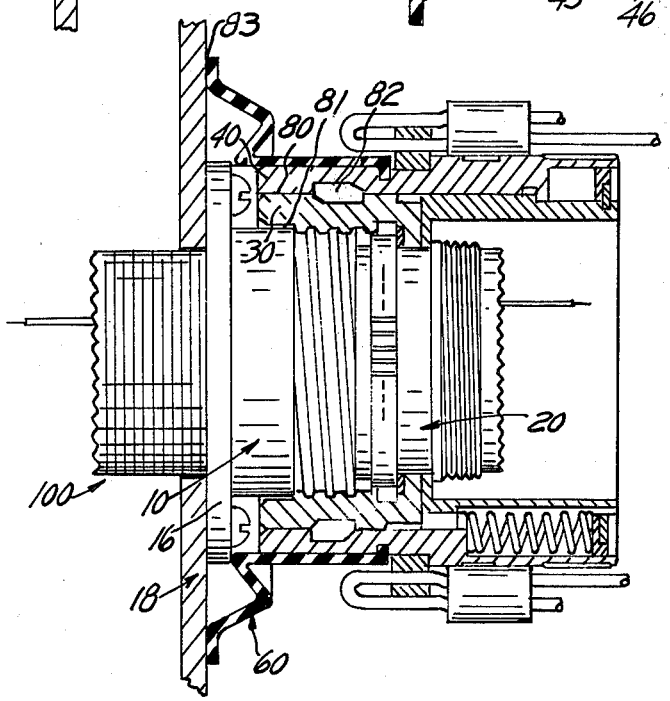
FIG. 2

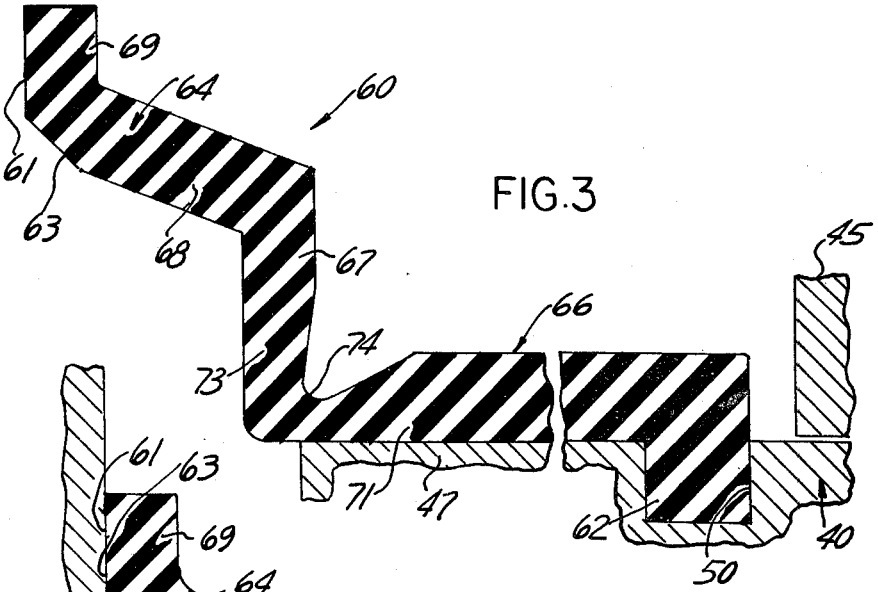
FIG.3
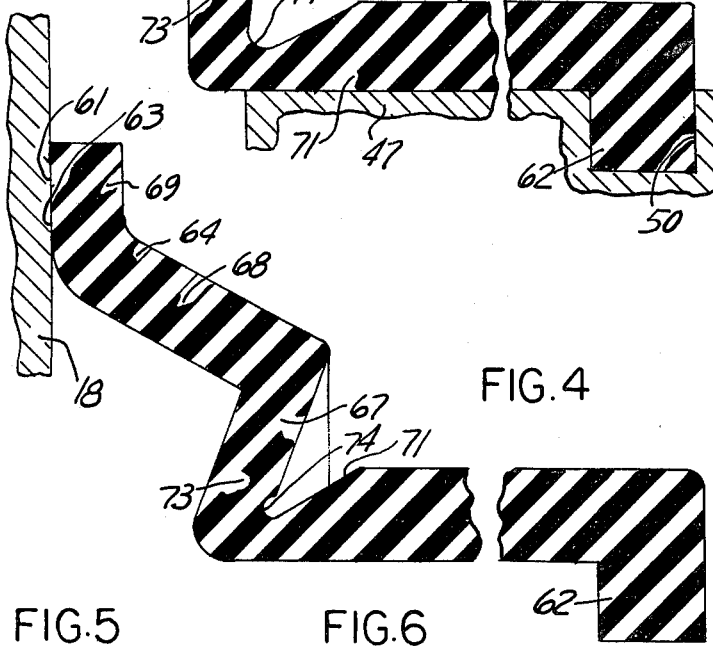
FIG.4
FIG.5
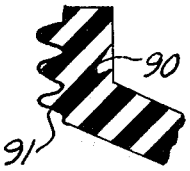
FIG.6
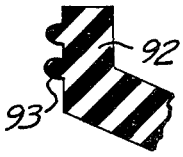
FIG.7
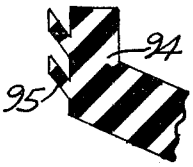
FIG.8
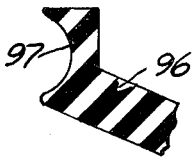
FIG.9
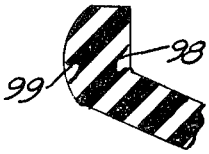

ELECTRICAL CONNECTOR HAVING A MOISTURE SEAL

This invention relates to an electrical connector having a moisture seal and more particularly to a "releasing electrical connector".

A "Releasing Electrical Connector" is shown in U.S. Pat. No. 4,279,458 issuing July 21, 1981, the specification and drawings thereof being specifically incorporated herein by reference. The releasing electrical connector when assembled, comprises a plug connector, a receptacle connector and a rotatable "coupling member" for releasably maintaining the connectors in a connected position. The "coupling member" is mounted to the plug connector and comprises a forward segmented housing, a rearward spring retainer including several coil springs and an operating sleeve circumposed thereabout, the coil springs normally biasing the operating sleeve in a forward direction and the operating sleeve being adapted to be acted upon by a lanyard and be moved in a rearward direction. For connection, a thread portion on each segment engages with thread formed on the receptacle connector. Disconnection is attained by rotating the "coupling member" in an uncoupling direction or by a "releasing" operation. In the releasing operation, force on the lanyard is transmitted from the operating sleeve and through the plug to the receptacle, resulting in the operating sleeve moving rearwardly and the housing segments being cammed (i.e., "blossoming") radially outward, thereby causing the thread portion on each segment to disengage with the thread formed on the receptacle connector, this thread disengagement allowing the plug connector to be released from the receptacle connector. In the "releasing" operation, the operating sleeve must move axially rearwardly about the plug connector and the segmented housings must blossom radially outwardly from the plug connector. When the plug and receptacle are mated and in particular when one connector is mounted to a panel, an air gap between the operating sleeve and segmented housings and an air gap surrounding the forward ends of the connectors when mated defines a region subject to attack by ice, moisture dust and the like.

Should moisture be received and freeze in the region surrounding the threaded front portion of the mated connector assembly, failure of the plug to release from the receptacle is possible. Dust could frustrate coupling rotations. In many environments, such as where both moisture and cold temperatures prevail, ice has a tendency to form. A current but severe ice resistance test, included in Mil-C-38999H imposes a requirement that a connector operate at a −55° C. after being immersed in water. If moisture or water is received in and freezes in either the threaded forward mating end or in the gap between the sleeve and segments, the ice formation could present a relatively severe problem to releasability in that blossoming of the segmented housings could be prevented or alternatively that the amount of lanyard force needed by the segments to break free of the frozen matter would be increased and the lanyard broken without an accompanying release.

Although O-rings and the like are known for moisture sealing, typically the ring acts on a principle of being squeezed between two sliding members and thus would increase resistance to movement and would be subject to wear.

Accordingly, it would be desirable to provide a sealing arrangement for standard connector parts of a releasing electrical connector arrangements which is self-contained on one connector part, that easily adapts to presently available connectors and which effectively prevents moisture from entering the forward portion of a connector body when mounted to a panel.

DISCLOSURE OF THE INVENTION

A releasing electrical connector including a coupling member for connecting a pair of electrical connectors and a moisture seal is characterized by the seal being a surface contact type and including an annular inward shoulder which is "snapped" into an annular cavity of a coupling sleeve, a tubular body which fits snugly about a cylindrical forward end of the sleeve, a forward frusto-conical cup having an annular foot which contacts a panel surface and a collapsible portion connecting the cup to the body, the cup collapsing rearwardly upon contact with the panel.

One advantage of the seal member is elimination of frictional forces, such as would be present in O-ring seals, that increase the pull-separation force of the connectors.

Another advantage of the seal member being collapsable upon contact is reduced wear and elimination of lubricants to reduce wear.

Yet a further advantage of the seal member is a rapidly replaceable, inexpensive sealing apparatus which can be discarded easily in the field when no longer needed or which has degraded with time.

Another advantage of the seal member is complete enclosure of the mating receptacle which offers added protection against many other environments (sand, dust etc.)

Still another advantage is provision of a member that seals, regardless of the receptacle type used, which is important since the distance between the panel and the front of the plug connector with operating sleeve could vary with different receptacle mountings.

DETAILED DESCRIPTION OF THE INVENTION

FIG. 1 shows in partial longitudinal section a releasing electrical connector having a moisture seal according to the present invention about to be mounted to a panel.

FIG. 2 shows in partial longitudinal section the releasing electrical connector of FIG. 1.

FIG. 3 is a section view of the moisture seal of FIG. 1 according to the present invention just prior to sealing.

FIG. 4 is a section view of the moisture seal of FIG. 2 in its sealed condition.

FIGS. 5–9 detail alternate end face embodiments for the moisture seal.

Referring now to the drawings, FIG. 1 shows a releasing electrical connector 100 including a first connector member (i.e., a receptacle shell) 10 having a socket-type contact 11 adapted to mate with a pin-type contact 21 in a second connector member (i.e., a plug shell) 20, dielectric inserts 12, 22 supported in the shells for mounting the respective pin and socket-type contacts, means for releasably coupling the first connector member 10 to the second connector member 20 and a moisture seal 60 for preventing moisture from entering the mated end of the connectors. The pin and socket contacts could be otherwise.

Plug connector 20 includes a forward engaging end portion 24, a rearward non-engaging end portion 25, a radial flange 26 medially disposed between the connector ends and an annular groove 27 adjacent the flange on the rearward non-engaging end portion.

Receptacle connector 10 includes a forward engaging end portion 14, a rearward non-engaging end portion 15 and a radial flange 16 medially disposed between the connector ends, forward engaging end portion 14 being provided with thread 17. Receptacle connector 10 is mounted in a panel 18 such that the receptacle forward engaging end portion 14 extends outwardly therefrom for mating engagement with forward engaging end portion 24 of plug connector 20, the plug engaging end portion 24 being adapted to telescope into the receptacle engaging end portion 14.

The means for releasably coupling the plug and receptacle connector members are as shown in the aforementioned U.S. Pat. No. 4,279,458 and, briefly, comprise: a segmented housing 30 having an inward radial flange 31 seated in annular groove 27 and a forward end 33 circumposed over forward engaging end 24 of plug 20; a spring retainer housing 34 having an inward radial flange 35 seated in annular groove 27 rearwardly of the segmented housing radial flange 31 and a plurality of longitudinally extending spring cavities 36; a helical spring 39 disposed in each cavity; and an operating sleeve 40 circumposed around the above assembly. Each helical spring 39 has a forward end which abuts a shoulder 41 of the operating sleeve and a rearward end which abuts a retaining ring 38 positioned at the rearward end of the cavity, the springs normally biasing the operating sleeve 40 into its forwardmost position. Each segmented housing 30 includes an internal thread 37 sized to engage (i.e. be screwed onto) the external thread 17 on receptacle 10 and an exterior cam portion 42 configured to fit a like cam portion 44 on the interior wall of the operating sleeve. Operating sleeve 40 is generally cylindrical and includes a forward end portion 47 and an annular shoulder 46 for positioning a lanyard retainer ring 45 having a lanyard 43 secured thereto. Forwardly of annular shoulder 46 is an annular cavity 50 which could be used to receive a snap ring (not shown) to captivate ring 45 to the sleeve. Lanyard 43 transmits forces to the operating sleeve and thus to the plug and receptacle connection, causing the sleeve to overcome the spring bias and move rearwardly, rearward sleeve movement causing the segmented housings to be cammed (i.e. "blossom") radially outward from engagement with thread on the receptable shell. The connector members are then released from their connection. Alternately the plug with coupling means could be disconnected by an "unscrewing" rotation about the receptacle.

Preferably and in accord with this invention a moisture seal 60 of surface contact-type is provided, the moisture seal having multi-portions being formed of a resilient rubber-like material, the portions being generally cylindrical in shape and coaxial and including means for sealing the forward end portion 47 of operating sleeve 40 and about forward engaging end portion 14 of receptacle 20 when mounted in a through aperture on panel 18. As shown, the moisture seal is mounted to the forward end portion 47 of the operating sleeve, the moisture seal having a radially inwardly directed annular shoulder 62 received within annular cavity 50 disposed around operating sleeve 40. As such annular shoulder 62 functions to seal against moisture and as a retaining ring for lanyard retainer ring 45, thereby eliminating need for the separate snap ring.

FIG. 2 shows moisture seal 60 in sealed contact with the surface of panel 18, the connectors engaged and the seal sealing the forward end portions of the engaged connectors. In particular, sealed from penetration moisture, ice, sand or dust is an air gap 80 between sleeve 40 and segment 30 leading to an air gap 82 defining therebetween the cam surfaces, an air gap 81 locally of the thread of the receptacle engaging end portion 14 and segmented housings and an air gap 83 surrounding the mounting of receptacle flange 16 to panel 18.

FIG. 3, in cooperation with FIG. 1, shows in cross-section moisture seal 60 mounted to the forward end portion of operating sleeve 40. Moisture seal 60 includes first means for sealing the forward end portion of operating sleeve 40, second means for sealing about receptacle 20 on panel 18 when mated to plug 10 and means for collapsibly connecting the first and second sealing means. Preferably and in accord with this invention the moisture seal is molded into one piece from an acellular elastomer. A suitable elastomer would be between 45–70 Durometer.

The first means for sealing forward end portion 47 of operating sleeve 40 comprises seal 60 including generally tubular body portion 66 having the radially inward annular shoulder 62, tubular body portion 66 being sized to fit snugly (i.e. squeeze) about the forward end portion of operating sleeve 40 and the radially inward annular shoulder 62 being sized to be compressed within and fill annular cavity 50 on operating sleeve 40, tubular body 66 and shoulder 62 cooperating to seal the end of operating sleeve 40 against ice and moisture penetration.

The second means for sealing about the receptacle when mounted to panel 18 comprises seal 60 including a generally regular, symmetrical, frusto-conically shaped cup portion 64, the cup portion including a tapered radially outwardly flaring skirt 68, an annular collar portion 67 and an annular foot portion 69, annular foot portion 69 extending radially outwardly from the larger opening of skirt 68 and annular collar portion 67 extending radially inwardly from the smaller opening of skirt 68. Annular foot portion 69 includes a substantially flat first end face 61 and a slightly chamfered second end face 63 defining a tapered surface extending radially inwardly therefrom.

The collapsible means include tubular body 66 having an end portion 71 adapted to be secured to a complimentary end portion 73 of annular collar 67, each of these end portions 71, 73 being of a gradually reduced thickness and converging to form a radial cut-out 74 at the point where they are joined. Cut-out 74 acts as a hinge at that point and allows the cup to "collapse".

FIG. 4, in cooperation with FIG. 2, shows a sealed relation. Here, due to the reduced thickness surrounding the radial cut-out, the cup functions somewhat like a leg-knee-leg-foot and collapses relative to tubular body 66. That is, cup 64 undergoes a "bellows" action to collapse about the receptacle flange 16, causing annular collar 67 to "fold" rearwardly and forcing skirt 68 and foot portion 69 radially outward, resulting in the first end face 61 and the chamfered second end face 62 there adjacent to substantially flatten and seal against the panel.

FIGS. 5–9 show alternate embodiments of the annular foot portion of the moisture seal. Recognizing that some mounting surfaces may be irregular, oily and possibly dirty, the annular foot may be desirably other than flat faced. Further, an irregular foot geometry could provide a "squeegee" action during collapse and force water radially outwardly of the skirt. FIGS. 5–7 show annular faces being provided with a succession of radial ribs extending from the foot, a redundant succession of ribs assuring that moisture not prevented by a first rib will either be prevented by a second rib or trapped between ribs. FIG. 5 shows three Vee-shaped ribs 91 extending from foot 90. FIG. 6 shows a pair of hemispherical ribs 93 extending from foot 92. FIG. 7 shows a pair of resilient tabs 95 extending from foot 94, the tabs being adapted to deflect downwardly. FIG. 8 shows a concave cavity 97 disposed on foot 96. FIG. 9 shows a rounded convex surface 99 on foot 98.

OPERATION

The lanyard retainer ring 45 would be telescoped about the forward end of operating sleeve 40 so as to abut annular shoulder 46. Moisture seal 60 would be telescopically fitted about the forward end 47 of operating sleeve 40, resulting in annular shoulder 62 fitting within annular cavity 50 and tubular body portion 66 squeezing and sealing about the operating sleeve. The releasing connector including plug connector 20 would then be rotatably coupled (i.e. screwed) to receptacle connector 10 mounted in panel 18, the rotation drawing the moisture seal 60 downwardly about receptacle flange 16 and the annular foot 69 onto the panel. Further rotation will result in cup portion 64 caving in (i.e. giving away) and collapsing about the mated forward ends 14, 24 of the connectors, the end face 61 being compressed against the panel and moisture sealing the connection.

While a preferred embodiment of this invention has been disclosed, it will be apparent to those skilled in the art, that changes may be made to the invention as set forth in the appended claims, and in some instances, certain features of the invention may be used to advantage without corresponding use of other features. Accordingly, it is intended that the illustrative and descriptive materials herein will be used to illustrate the principles of the invention and not to limit the scope thereof.

We claim:

1. A releasing electrical connector having a moisture seal, the releasing electrical connector including a pair of connector members (10, 20) with each having, respectively, a forward end portion (14, 24), a duality of electrical contacts (11, 21) carried by said connector members and forming an electrical interconnection, and means (30, 34, 40, 39, 37, 17) for releasably coupling the connector members, one of the connector members (10) being mounted in a panel (18) and having its forward end portion (14) extending therefrom and mated with the forward end portion (24) of the other connector member (20), the releasable coupling means including an operating sleeve (40) disposed about the mated end portions (14, 24), said moisture seal characterized by:

said operating sleeve (40) having an annular cavity (50) disposed in the outer surface thereof; and a resilient seal member (60) including a tubular portion (66), a collapsible cup portion (64), and a hinge-like connection therebetween defined by each said portion having an end portion (71, 73) of reduced thickness being connected together, said cup portion including a foot portion (67) having a substantially flat forward end face (61) and said cup portion being disposed around the mated end portions (14, 24) such that said forward end face (61) thereof is compressed against the panel (18), said tubular portion (66) being arranged snugly about the forward end portion of the operating sleeve (40) and having a radially inwardly directed annular shoulder (62) disposed within said annular cavity (50) in said operating sleeve (40), said foot portion (67) further having a chamfered end face (63) extending from said flat end face (61) with said end faces (61, 63) being adapted to flatten against the panel (18), said connector members being coupled together causing the cup (64) to collapse about the panel (18) and the second end face (63) to flatten against the panel.

2. The releasing electrical connector as recited in claim 1 wherein seal member (60) is integrally molded into one-piece from an acellular elastomer.

3. The releasing electrical connector as recited in claim 1 wherein said cup portion (64) is a frusto-conical shape and includes a skirt (68) having an annular collar (67) connected thereto, said annular collar (67) having remote from its connection to said skirt (68) one said end portion (73) of reduced thickness and said tubular portion (66) includes the other said end portion (71) of reduced thickness at a location remote from its annular shoulder (62), said end portions (71, 73) being connected together to form a radial cut-out (74) and define said hinge-like connection between said cup portion (64) and said tubular portion (66).

4. The releasing electrical connector as recited in claim 3 wherein said foot (67) is extending radially outwardly from the skirt (68).

5. The releasing electrical connector as recited in claim 1 wherein a rib (91) for enhancing sealing against the panel (18) extends outwardly from the end face (61).

6. The releasing electrical connector as recited in claim 5 wherein a pair of radial ribs (91) extend outwardly from said end face (61).

* * * * *